US010443383B2

(12) United States Patent
Fenton

(10) Patent No.: US 10,443,383 B2
(45) Date of Patent: Oct. 15, 2019

(54) ROTATIONAL DISPLACEMENT APPARATUS

(71) Applicant: FeTu Limited, Eland (GB)

(72) Inventor: Jonathan Paul Fenton, Elland (GB)

(73) Assignee: FETU LIMITED, Elland (GB)

( * ) Notice: Subject to any disclaimer, the term of this patent is extended or adjusted under 35 U.S.C. 154(b) by 54 days.

(21) Appl. No.: 15/552,451

(22) PCT Filed: Aug. 5, 2016

(86) PCT No.: PCT/GB2016/052429

§ 371 (c)(1),
(2) Date: Aug. 21, 2017

(87) PCT Pub. No.: WO2017/089740

PCT Pub. Date: Jun. 1, 2017

(65) Prior Publication Data

US 2018/0045052 A1 Feb. 15, 2018

(30) Foreign Application Priority Data

Nov. 25, 2015 (GB) ..... 1520830.9
Dec. 1, 2015 (GB) ..... 1521207.9

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F01C 3/00*** | (2006.01) |

(Continued)

(52) U.S. Cl.

CPC ..... *F01C 9/005* (2013.01); *F01C 21/08* (2013.01); *F04C 18/48* (2013.01); *F04C 21/002* (2013.01); *F04C 21/005* (2013.01); *F01C 3/00* (2013.01); *F01C 3/06* (2013.01); *F02B 53/00* (2013.01); *F02B 53/02* (2013.01)

(58) Field of Classification Search

CPC ..... F01C 3/00; F01C 3/02; F01C 3/06; F01C 9/00; F01C 9/005; F01C 21/002; F01C 21/08; F04C 18/48; F04C 21/00; F04C 21/002; F04C 21/005; F04C 21/007; F02B 53/00; F02B 53/02; F02B 53/10; F02B 53/12

USPC ..... 418/53, 68, 193, 195; 123/18 R, 233, 123/235, 241, 245

See application file for complete search history.

(56) References Cited

U.S. PATENT DOCUMENTS 1,967,167 A 7/1934 Weis
3,769,944 A * 11/1973 Raymond ..... F01C 9/005 123/235

(Continued)

FOREIGN PATENT DOCUMENTS

CN 104775899 A 7/2015
FR 2295266 A1 8/1976

*Primary Examiner* — Theresa Trieu

(74) *Attorney, Agent, or Firm* — Coats & Bennett, PLLC

(57) ABSTRACT

An apparatus including a first piston member rotatable about a first rotational axis and a rotor with a first chamber and pivotable about a second rotational axis. The first piston member extends across the first chamber. The rotor and first piston member are rotatable around the first rotational axis, and the rotor is pivotable about the second rotational axis to permit a relative pivoting motion between the rotor and the first piston member linked to the rotor rotating about the first rotational axis.

20 Claims, 13 Drawing Sheets

(51) Int. Cl.

| | |
|---|---|
| ***F01C 9/00*** | (2006.01) |
| ***F04C 21/00*** | (2006.01) |
| ***F04C 18/48*** | (2006.01) |
| ***F01C 21/08*** | (2006.01) |
| *F01C 3/06* | (2006.01) |
| *F02B 53/02* | (2006.01) |
| *F02B 53/00* | (2006.01) |

(56) References Cited

U.S. PATENT DOCUMENTS

| | | | | |
|---|---|---|---|---|
| 3,973,469 | A | 8/1976 | Humen | |
| 6,325,038 | B1 | 12/2001 | Millett | |
| 6,442,935 | B1 * | 9/2002 | Larsen | F01C 9/005 123/241 |
| 2002/0043238 | A1 | 4/2002 | McMaster et al. | |
| 2007/0209632 | A1 * | 9/2007 | Wagner | F01C 9/005 123/241 |
| 2009/0031979 | A1 * | 2/2009 | Huettlin | F01C 9/005 123/18 A |

* cited by examiner

ROTATIONAL DISPLACEMENT APPARATUS

BACKGROUND

Conventional fluid pumps and internal combustion engines that comprise a 'cranked' reciprocating arrangement to drive a piston are of course well known and understood in the art. The demerit of these arrangements is the need, and losses arising from, the translation of linear motion of a piston into a rotational motion of the shaft to which the piston is attached.

Likewise, conventional apparatus for displacement or expansion of fluids, or which are operable by a flow of fluid through them, that comprise a reciprocating arrangement to drive a piston, suffer from the same problem.

A fluid compression apparatus which avoids the need for such a crank based translation from a linear to a rotational motion is highly desirable.

Likewise, an apparatus which achieves the same technical effect as conventional fluid displacement, expansion or flow apparatus, but which avoids the need for such conventional crank translation from a linear to a rotational motion, is highly desirable.

SUMMARY

According to the present disclosure there is provided an apparatus and method as set forth in the appended claims. Other features of the invention will be apparent from the dependent claims, and the description which follows.

Accordingly there may be provided an apparatus comprising: a shaft which defines and is rotatable about a first rotational axis; an axle defining a second rotational axis, the shaft extending through the axle; a first piston member provided on the shaft, the first piston member extending from the axle towards a distal end of the shaft; a rotor carried on the axle; the rotor comprising a first chamber, the first piston member extending across the first chamber; whereby: the rotor and axle are rotatable with the shaft around the first rotational axis; and the rotor is pivotable about the axle about the second rotational axis to permit relative pivoting motion between the rotor and the first piston member as the rotor rotates about the first rotational axis.

The first chamber may have a first opening; and the first piston member extends from the axle across the first chamber towards the first opening.

The axle may be provided substantially half way between ends of the shaft.

The first piston member may extend from one side of the axle along the shaft; and a second piston member extends from the other side of the axle along the shaft, the rotor comprising a second chamber to permit relative pivoting motion between the rotor and the second piston member as the rotor rotates about the first rotational axis.

The second chamber may have a second opening; and the second piston member may extend from the axle across the second chamber towards the second opening.

There may be provided a closeable flow passage between the first chamber and the second chamber.

The closeable flow passage may comprise a flow path in the axle which is open when the rotor is pivoted to one extent of its pivot, and closed as the rotor is pivoted towards its other extent of its pivot.

The shaft, axle and piston member(s) may be fixed relative to one another.

The second rotational axis may be substantially perpendicular to the first rotational axis.

The apparatus may further comprise: a housing having a wall which defines a cavity; the rotor being rotatable and pivotable within the cavity; and disposed relative to the housing such that a small clearance is maintained between the rotor over the majority of the wall.

The housing may further comprise a bearing arrangement for carrying the shaft.

The piston member(s) may be sized to terminate proximate to the wall of the housing, a small clearance being maintained between the end of the piston member and the housing wall.

The housing may further comprise at least one port per chamber for communication of fluid between a fluid passage and the respective chamber.

For each chamber, the housing may further comprise an inlet port for delivering fluid into the chamber; and an exhaust port for expelling fluid from the chamber.

The ports may be sized and positioned on the housing such that: in a first set of relative positions of the ports and the respective rotor openings, the ports and rotor openings are out of alignment such that the openings are fully closed by the wall of the housing to prevent fluid flow between the chamber(s) and port(s); and in a second set of relative positions of the ports and the respective rotor openings, the openings are at least partly aligned with the ports such that the openings are at least partly open to allow fluid to flow between the chamber(s) and port(s).

The apparatus may further comprise: a pivot actuator operable to pivot the rotor about the axle.

The pivot actuator may further comprise: a first guide feature on the rotor; and a second guide feature on the housing; the first guide feature being complementary in shape to the second guide feature; and one of the first or second guide features defining a path which the other of the first or second guide members is constrained to follow; thereby inducing the rotor to pivot about the axle.

The guide path may describe a path around a first circumference of the rotor or housing, the guide path comprising at least: a first inflexion which directs the path away from a first side of the first circumference and then back toward a second side of the first circumference; and a second inflexion which directs the path away from the second side of the first circumference and then back toward the first side of the first circumference.

The chamber(s) may be in fluid communication with a fuel supply.

The chamber(s) may be in fluid communication with a fuel ignition device.

The first chamber may be specifically adapted for compression, and/or displacement, and/or flow, and/or expansion of a fluid.

The second chamber is specifically adapted for compression, and/or displacement, and/or flow, and/or expansion of a fluid.

There may also be provided an apparatus comprising: a first piston member rotatable about a first rotational axis; a rotor comprising a first chamber and pivotable about a second rotational axis, the first piston member extending across the first chamber; whereby: the rotor and first piston member are rotatable around the first rotational axis; and the rotor is pivotable about the second rotational axis to permit relative pivoting motion between the rotor and the first piston member linked to the rotor rotating about the first rotational axis.

There may also be provided a method of operation of an apparatus: the apparatus comprising: a first piston member rotatable about a first rotational axis; a rotor comprising a first chamber and pivotable about a second rotational axis, the first piston member extending across the first chamber; whereby in operation: the rotor and first piston member rotate around the first rotational axis; and the rotor pivots about the second rotational axis such that there is a relative pivoting motion between the rotor and the first piston member which varies the volume of the first chamber, the change in chamber volume being linked to rotation of the rotor about the first rotational axis.

There may also be provided a fluid compression apparatus comprising: a shaft which defines and is rotatable about a first rotational axis; an axle defining a second rotational axis; the shaft extending at an angle through the axle; a first piston member provided on the shaft, the first piston member extending from the axle towards a distal end of the shaft; a rotor carried on the axle, the rotor being pivotable relative to the axle about the second rotational axis; the rotor comprising a first compression chamber, the first compression chamber having a first opening; and the first piston member extending from the axle across the first compression chamber towards the first opening; the rotor being rotatable with the axle and shaft around the first rotational axis; and pivotable about the axle about the second rotational axis such that the first piston member is operable to travel from one side of the first compression chamber to an opposing side of the first compression chamber as the rotor rotates about the first rotational axis to thereby compress fluid within the first compression chamber.

There may also be provided a fluid compression apparatus comprising: a shaft which defines and is rotatable about a first rotational axis; an axle defining a second rotational axis; the shaft extending at an angle through the axle; a first piston member provided on the shaft, the first piston member extending from the axle towards a distal end of the shaft; a rotor carried on the axle, the rotor being pivotable relative to the axle about the second rotational axis; the rotor comprising a first compression chamber, the first compression chamber having a first opening; and the first piston member extending from the axle across the first compression chamber towards the first opening; the rotor being rotatable with the axle and shaft around the first rotational axis; and pivotable about the axle about the second rotational axis such that the first piston member is operable to traverse from one side of the first compression chamber to an opposing side of the first compression chamber when a guiding force is applied to the periphery of the rotor as the rotor rotates about the first rotational axis to thereby compress fluid within the first compression chamber.

There may also be provided a fluid compression apparatus comprising: a shaft which defines and is rotatable about a first rotational axis; an axle defining a second rotational axis, the shaft extending through the axle; a first piston member provided on the shaft, the first piston member extending from the axle towards a distal end of the shaft; a rotor carried on the axle; the rotor comprising a first compression chamber, the first compression chamber having a first opening; and the first piston member extending from the axle across the first compression chamber towards the first opening; whereby: the rotor is rotatable with the shaft around the first rotational axis; and the rotor is pivotable about the axle about the second rotational axis such that relative pivoting motion between the rotor and the first piston member as the rotor rotates about the first rotational axis acts to compress fluid within the first compression chamber.

The axle may be provided substantially at the centre of the shaft. The axle may be provided substantially half way between ends of the shaft.

The first piston member may extend from one side of the axle along the shaft; and a second piston member may extend from the other side of the axle along the shaft, the rotor comprising a second compression chamber having a second opening; wherein: the second piston member extends from the axle across the second compression chamber towards the second opening; such that the second piston member is operable to travel from one side of the second compression chamber to an opposing side of the second compression chamber as the rotor rotates about the first rotational axis to thereby compress fluid within the second compression chamber.

The first piston member may extend from one side of the axle along the shaft; and a second piston member may extend from the other side of the axle along the shaft, the rotor comprising a second compression chamber having a second opening; wherein: the second piston member extends from the axle across the second compression chamber towards the second opening; such that relative pivoting motion between the rotor and the second piston member as the rotor rotates about the first rotational axis acts to compress fluid within the second compression chamber.

There may be provided a closeable flow passage between the first compression chamber and the second compression chamber.

The closeable flow passage may comprise a flow path in the axle which is open when the rotor is pivoted to one extent of its pivot, and closed as the rotor is pivoted towards its other extent of its pivot.

The shaft, axle and piston member(s) may be fixed relative to one another.

The second rotational axis may be substantially perpendicular to the first rotational axis.

The fluid compression apparatus may further comprise: a housing having a wall which defines a cavity; the rotor being rotatable and pivotable within the cavity; and disposed relative to the housing such that a small clearance is maintained between the compression chamber opening(s) over the majority of the wall.

The housing may further comprise a bearing arrangement for carrying the shaft.

The piston member(s) may be sized to terminate proximate to the wall of the housing, a small clearance being maintained between the end of the piston member and the housing wall.

The housing may further comprise at least one port per compression chamber for communication of fluid between a fluid passage and the respective compression chamber.

For each compression chamber, the housing may further comprise an inlet port for delivering fluid into the compression chamber; and an exhaust port for expelling fluid from the compression chamber.

The ports may be sized and positioned on the housing such that: in a first range of relative positions of the ports and the respective rotor openings, the ports and rotor openings are out of alignment such that the openings are fully closed by the wall of the housing to prevent fluid flow between the compression chamber(s) and port(s); and in a second range of relative positions of the ports and the respective rotor openings, the openings are at least partly aligned with the ports such that the openings are at least partly open to allow fluid to flow between the compression chamber(s) and port(s).

The apparatus may further comprise a pivot actuator operable to pivot the rotor about the axle. That is to say, the apparatus may further comprise a pivot actuator operable to pivot the rotor about the second rotational axis defined by the axle. Put another way, the apparatus may further comprise a pivot actuator operable to pivot the rotor about the second rotational axis defined by the axle while the rotor is rotating about the first rotational axis defined by the shaft.

The pivot actuator may comprise a first guide feature on the rotor; and a second guide feature on the housing; the first guide feature being complementary in shape to the second guide feature; and one of the first or second guide features defining a path which the other of the first or second guide members is constrained to follow as the rotor rotates; thereby inducing the rotor to pivot about the axle.

The path may have a route configured to induce the rotor to pivot about the axle.

The guide path may describe a path around a first circumference of the rotor or housing, the guide path comprising at least: a first inflexion which directs the path away from a first side of the first circumference and toward a second side of the first circumference; and a second inflexion which directs the path away from the second side of the first circumference and back toward the first side of the first circumference.

The guide path may describe a path around a first circumference of the rotor or housing, the guide path comprising at least: a first inflexion which directs the path away from a first side of the first circumference and then back toward a second side of the first circumference; and a second inflexion which directs the path away from the second side of the first circumference and then back toward the first side of the first circumference.

The compression chamber(s) may be in fluid communication with a fuel supply.

The compression chamber(s) may be in fluid communication with a fuel ignition device.

There may thus be provided a fluid compression apparatus, which may form part of a fluid pump or an internal combustion engine, which is operable to work fluid as required by use of a pivoting rotor and piston arrangement.

There may thus also be provided working elements of a fluid displacement apparatus, fluid expansion apparatus and/or fluid actuated apparatus.

The apparatus may be described as a 'roticulater' since the rotor of the present disclosure is operable to simultaneously 'rotate' and 'articulate'. Hence there is provided a 'roticulating apparatus' which may form part of a fluid compression apparatus (e.g. fluid pump or an internal combustion engine), fluid displacement apparatus, fluid expansion apparatus or fluid actuated apparatus.

BRIEF DESCRIPTION OF THE DRAWINGS

Examples of the present disclosure will now be described with reference to the accompanying drawings, in which.

DETAILED DESCRIPTION

The apparatus and method of the present disclosure is described below. The apparatus is suitable for use as part of a fluid compression device (e.g. fluid pump or an internal combustion engine), fluid displacement device, fluid expansion device and fluid actuated device (for example, a device driven by the flow of fluid there through). That is to say the apparatus may be specifically adapted for compression, and/or displacement, and/or flow, and/or expansion of a fluid. The term "fluid" is intended to have its normal meaning, for example: a liquid, gas or combination of liquid and gas, or material behaving as a fluid. Core elements of the apparatus are described as well as non-limiting examples of applications in which the apparatus may be employed.

Figure 1:
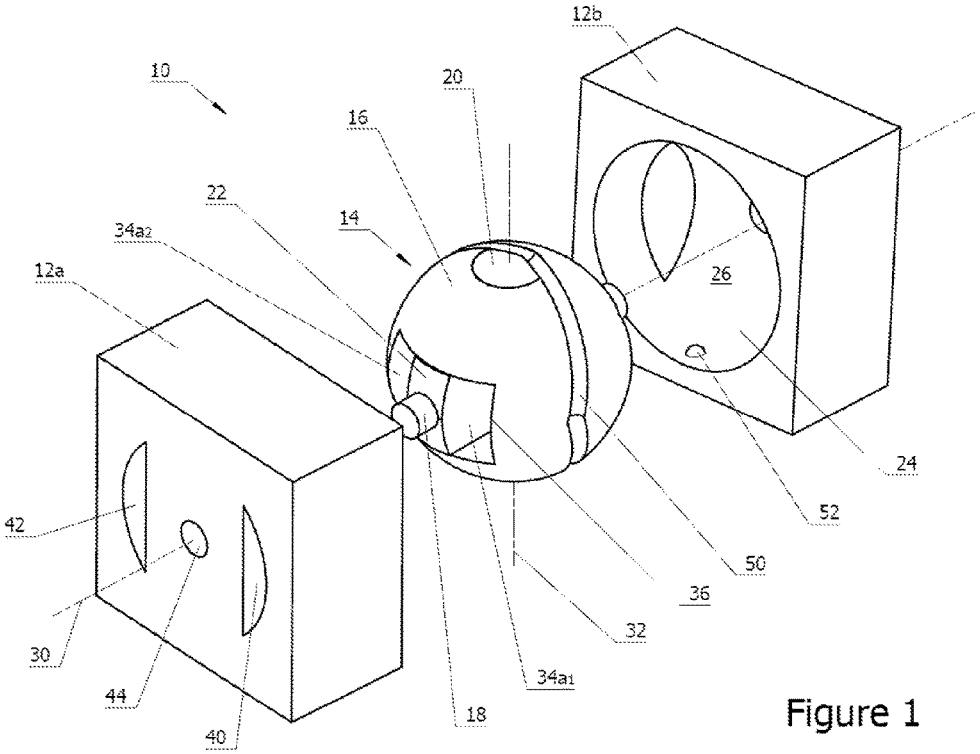
FIG. 1 shows a part exploded view of an example of an apparatus, including a rotor assembly and housing, according to the present disclosure.
Figure 2:
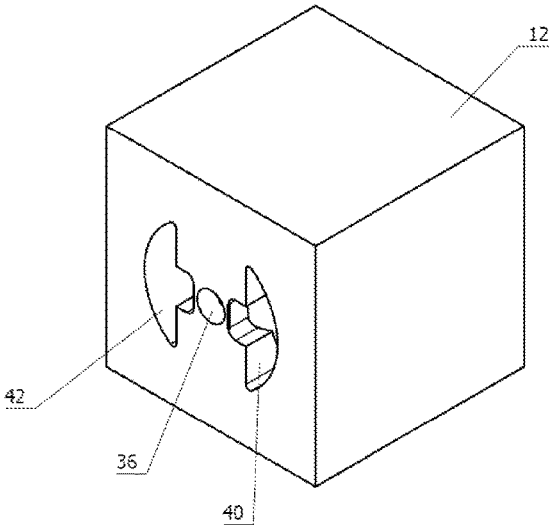
FIG. 2 shows a perspective external view of an alternative example of a housing for an apparatus to that shown in FIG. 1.

FIG. 1 shows a part exploded view of an apparatus 10 according to the present disclosure having a housing 12 and rotor assembly 14. FIG. 2 shows an example of the housing 12 when it is closed around the rotor assembly 14. In the example shown the housing 12 is divided into two parts 12*a*, 12*b* which close around the rotor assembly 14. However, in an alternative example the housing may be fabricated from more than two parts, and/or split differently to that shown in FIG. 1.

The rotor assembly 14 comprises a rotor 16, a shaft 18, an axle 20 and a piston member 22. The housing 12 has a wall 24 which defines a cavity 26, the rotor 16 being rotatable and pivotable within the cavity 26.

The shaft 18 defines, and is rotatable about, a first rotational axis 30. The axle 20 extends around the shaft 18. The axle extends at an angle to the shaft 18. Additionally the axle defines a second rotational axis 32. Put another way, the axle 20 defines the second rotational axis 32, and the shaft 18 extends through the axle 20 at an angle to the axle 20. The piston member 22 is provided on the shaft 18.

In the examples shown the apparatus is provided with two piston members 22, i.e. a first and second piston member 22. The rotor 16 also defines two chambers 34*a,b*, one diametrically opposite the other on either side of the rotor 16.

In examples in which the apparatus is part of a fluid compression device, each chamber 34 may be provided as a compression chamber. Likewise, in examples in which the apparatus is a fluid displacement device, each chamber 34 may be provided as a displacement chamber. In examples in which the apparatus is a fluid expansion device, each chamber 34 may be provided as an expansion chamber. In examples in which the apparatus is a fluid actuated device, each chamber 34 may be provided as a fluid flow chamber.

In the examples shown the compression chambers 34*a*, 34*b* on each side of the rotor 16 have the same volume. In alternative examples, the compression chamber on one side of the rotor may have a different volume to the other compression chamber. For example, in an example in which the apparatus forms part of an internal combustion engine, a chamber 34*a* acting nominally as an inlet (e.g. where air is drawn in) may be provided with a larger volume than a chamber 34*b* on the other side of the rotor 16 which nominally acts as an outlet/exhaust.

Although the piston member 22 may in fact be one piece that extends all of the way through the rotor assembly 14, this arrangement effectively means each chamber 34 is provided with a piston member 22. That is to say, although the piston member 22 may comprise only one part, it may form two piston members sections 22, one on either side of the rotor assembly 14.

Put another way, a first piston member 22 extends from one side of the axle 20 along the shaft 18 towards one side of the housing 12, and a second piston member 22 extends from the other side of the axle 20 along the shaft 18 towards the other side of the housing 12. The rotor 16 comprises a first chamber 34*a* having a first opening 36 on one side of the rotor assembly 14, and a second chamber 34*b* having a second opening 36 on the other side of the rotor assembly 14. The rotor 16 is carried on the axle 20, the rotor 16 being pivotable relative to the axle 20 about the second rotational axis 32. The piston member 22 extends from the axle 20 across the chambers 34*a,b* towards the openings 36. A small clearance is maintained between the edges of the piston member 22 and the wall of the rotor 16 which defines the chamber 34. The clearance may be small enough to provide a seal between the edges of the piston member 22 and the wall of the rotor 16 which defines the chamber 34. Alternatively, or additionally, sealing members may be provided between the piston members 22 and the wall of the rotor 16 which defines the chamber 34.

The chambers 34 are defined by side walls (i.e. end walls of the chambers 34) which travel to and from the piston members 22, the side walls being joined by boundary walls which travel past the sides of the piston member 22. That is to say, the chambers 34 are defined by side/end walls and boundary walls provided in the rotor 16.

Hence the rotor 16 is rotatable with the shaft 18 around the first rotational axis 30, and pivotable about the axle 20 about the second rotational axis 32. This configuration results in the first piston member 22 being operable to travel (i.e. traverse) from one side of the first chamber 34*a* to an opposing side of the first chamber 34*a* as the rotor 16 rotates about the first rotational axis 30. Put another way, since the rotor 16 is rotatable with the shaft 18 around the first rotational axis 30, and the rotor 16 is pivotable about the axle 20 about the second rotational axis 32, during operation there is a relative pivoting (i.e. rocking) motion between the rotor 16 and the first piston member 22 as the rotor 16 rotates about the first rotational axis 30. That is to say, the apparatus is configured to permit a controlled pivoting motion of the rotor 16 relative to the first piston member 22 as the rotor 16 rotates about the first rotational axis 30.

In examples where the apparatus is part of a fluid compression apparatus, the pivoting motion acts to compress fluid within the first chamber 34*a* as a side wall of the first chamber 34*a* is moved towards the first piston member 22.

In examples where the apparatus is part of a fluid displacement apparatus, the pivoting motion acts to displace fluid from the first chamber 34*a* as a side wall of the first chamber 34*a* is moved towards the first piston member 22.

In examples where the apparatus is part of a fluid expansion apparatus, the pivoting motion is caused by the expansion of fluid within the chamber 34*a* to thereby move a side wall of the first chamber 34*a* away from the first piston member 22.

In examples where the apparatus is part of a fluid actuated apparatus, the pivoting motion is caused by the flow of fluid into the chamber 34*a* to thereby move a side wall of the first chamber 34*a* away from the first piston member 22.

The configuration also results in the second piston member 22 being operable to travel (i.e. traverse) from one side of the second chamber 34*b* to an opposing side of the second chamber 34*b* as the rotor 16 rotates about the first rotational axis 30. Put another way, since the rotor 16 is rotatable with the shaft 18 around the first rotational axis 30, and the rotor 16 is pivotable about the axle 20 about the second rotational axis 32, during operation there is a relative pivoting (i.e. rocking) motion between the rotor 16 and both piston members 22 as the rotor 16 rotates about the first rotational axis 30. That is to say, the apparatus is configured to permit a controlled pivoting motion of the rotor 16 relative to both piston members 22 as the rotor 16 rotates about the first rotational axis 30.

In examples where the apparatus is part of a fluid compression apparatus, fluid is thus compressed within the second chamber 34*b* at the same time as fluid is being compressed within the first chamber 34*a* on the opposite side of the rotor assembly 14. Hence the pivoting motion acts to compress fluid within the first and second chambers 34*a,b* as side walls of the chambers 34*a,b* are moved towards their respective piston members 22.

In examples where the apparatus is part of a fluid displacement apparatus, fluid is thus displaced within the second chamber 34*b* at the same time as fluid is being displaced within the first chamber 34*a* on the opposite side of the rotor assembly 14.

In examples where the apparatus is part of a fluid expansion apparatus, fluid is thus expanded within the second chamber 34*b* at the same time as fluid is being expanded within the first chamber 34*a* on the opposite side of the rotor assembly 14.

In examples where the apparatus is part of a fluid actuated apparatus, the pivoting motion is caused by the flow of fluid into the chamber 34*b* to thereby move a side wall of the first chamber 34*b* away from the first piston member 22 at the same time as the flow of fluid into the chamber 34*a* moves a side wall of the first chamber 34*a* away from the first piston member 22.

Put another way, as the rotor 16 and first piston member 22 rotate around the first rotational axis 30, and as the rotor 16 pivots about the second rotational axis 32, there is a relative pivoting (i.e. rocking) motion between the rotor 16 and the first piston member 22 which varies the volume of the first chamber, the change in chamber volume being linked to rotation of the rotor 16 about the first rotational axis 30. The relative pivoting motion is induced by a pivot actuator, as described below.

In examples in which the apparatus forms part of a fluid pump, the rotor 16 and the first piston member 22 pivot (i.e. move) relative to one another in response to rotation of the rotor 16 about the first rotational axis 30.

In examples in which the apparatus forms part of an internal combustion engine, the rotor 16 and the first piston member 22 pivot (i.e. move) relative to one another to cause rotation of the rotor 16 about the first rotational axis 30.

The mounting of the rotor 16 such that it may pivot (i.e. rock) relative to the piston members 22 means there is provided a moveable division between two halves of the or each chambers 34*a,b* to form sub-chambers 34*a*1, 34*a*2, 34*b*3, 34*b*4 within the chambers 34*a*,34*b*. In operation the volume of each sub chamber 34*a*1, 34*a*2, 34*b*3 and 34*b*3 varies depending on the relative orientation of the rotor 16 and piston members 22.

When the housing 12 is closed about the rotor assembly 14, the rotor 16 is disposed relative to the housing wall 24 such that a small clearance is maintained between the chamber opening 34 over the majority of the wall 24. The clearance may be small enough to provide a seal between the rotor 16 and the housing wall 24.

Alternatively or additionally, sealing members may be provided in the clearance between the housing wall 24 and rotor 16.

Ports are provided for the communication of fluid to and from the chambers 34*a,b*. For each chamber 34, the housing 12 may comprise an inlet port 40 for delivering fluid into the chamber 34, and an exhaust port 42 for expelling fluid from the chamber 34. The inlet and outlet/exhaust ports 40, 42 are shown with different geometries in FIG. 1 and FIG. 2. In FIG. 1 the ports are shown as "crescent shaped", and in FIG. 2 as "T" shaped. Both are non limiting examples of geometries which may be adopted depending on the required configuration of the apparatus. The ports 40, 42 extend through the housing and open onto the wall 24 of the housing 12. Also provided is a bearing arrangement 44 for supporting the ends of the shaft 18. This may be of any conventional kind suitable for the application.

The ports 40, 42 may be sized and positioned on the housing 12 such that, in operation, when respective chamber openings 36 move past the ports 40, 42, in a first relative position the openings 36 are aligned with the ports 40, 42 such that the chamber openings are fully open, in a second relative position the openings 36 are out of alignment such that the openings 36 are fully closed by the wall 24 of the housing 12, and in an intermediate relative position, the openings 36 are partly aligned with the ports 40, 42 such that the openings 36 are partly restricted by the wall of the housing 24.

Alternatively, the ports 40,42 may be sized and positioned on the housing 12 such that, in operation, in a first range (or set) of relative positions of the ports 40,42 and the respective rotor openings 36, the ports 40,42 and rotor openings 36 are out of alignment such that the openings 36 are fully closed by the wall 24 of the housing 12 to prevent fluid flow between the chamber(s) 34*a,b* and port(s) 40,42. At the same time the port 40, 42 opening may also be closed by the periphery of the body of the rotor to prevent fluid flow between the chamber(s) 34*a,b* and port(s) 40,42. In a second range (or set) of relative positions of the ports 40,42 and the respective rotor chamber openings 36, the openings 36 are at least partly aligned with the ports 40,42 such that the openings 36 are at least partly open to allow fluid to flow between the chamber(s) 34*a,b* and port(s) 40,42.

The placement and sizing of the ports may vary according to the application (i.e. whether used as part of a fluid pump apparatus, fluid displacement apparatus, fluid expansion apparatus of fluid actuated apparatus) to facilitate best possible operational efficiency. The port locations herein described and shown in the figures is merely indicative of the principle of media (e.g. fluid) entry and exit.

In some examples of the apparatus of the present disclosure (not shown) the inlet ports and outlet ports may be provided with mechanical or electro-mechanical valves operable to control the flow of fluid/media through the ports 40,42.

Figure 3:
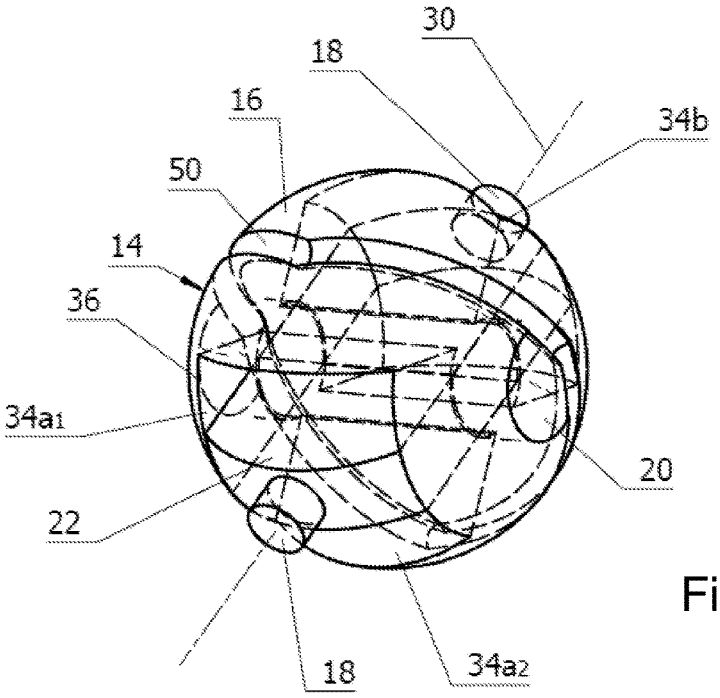
FIG. 3 shows a perspective view of the rotor assembly shown in FIG. 1.
Figure 4:
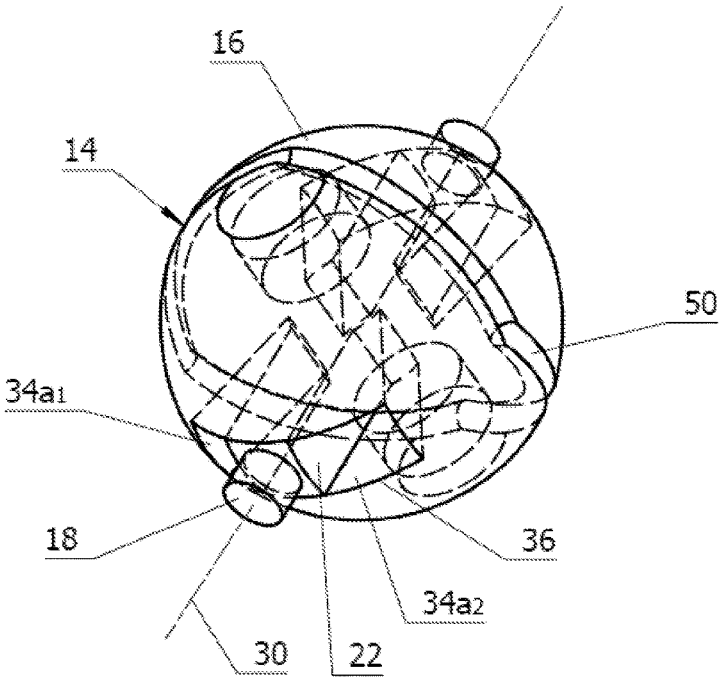
FIG. 4 shows an alternative example of a rotor assembly to that shown in FIG. 3.

FIGS. 3, 4 show an enlarged view of two examples of a rotor assembly 14 according to the present disclosure.

The example of FIG. 3 corresponds to the example shown in FIG. 1. By comparison however, the example of FIG. 4 shows an alternative example, rotated through 90 degrees around the first rotational axis 30, compared to that of FIG. 3. The two examples are essentially the same, however in the example of FIG. 4 the chamber 34 has a different aspect ratio to that of the one shown in FIG. 3, with the piston member 22 being much narrower. It will be appreciated that the aspect ratio of the chamber 34, and hence the width of the piston member 22, will be chosen according to the required capacity of the apparatus.

The apparatus comprises a pivot actuator operable (i.e. configured) to pivot the rotor 16 about the axle 20. That is to say, the apparatus may further comprise a pivot actuator operable (i.e. configured) to pivot the rotor 16 about the second rotational axis 32 defined by the axle 20. The pivot actuator may be configured to pivot the rotor 16 by any angle appropriate for the required performance of the apparatus. For example the pivot actuator may be operable to pivot the rotor 16 through an angle of substantially about 60 degrees.

The pivot actuator may comprise, as shown in the examples, a first guide feature on the rotor 16, and a second guide feature on the housing 12. Hence the pivot actuator may provide as a mechanical link between the rotor 16 and housing 12 configured to induce a controlled relative pivoting motion of the rotor 16 relative to the piston member 22 as the rotor 16 rotates about the first rotational axis 30. That is to say, it is the relative movement of the rotor 16 acting against the guide features of the pivot actuator which induces the pivoting motion of the rotor 16.

The first guide feature is complementary in shape to the second guide feature. One of the first or second guide features define a path which the other of the first or second guide members features is constrained to follow as the rotor rotates about the first rotational axis 30. The path, perhaps provided as a groove, has a route configured to induce the rotor 16 to pivot about the axle 20 and axis 32. This route also acts to set the mechanical advantage between the rotation and pivoting of the rotor 16.

Figure 5:
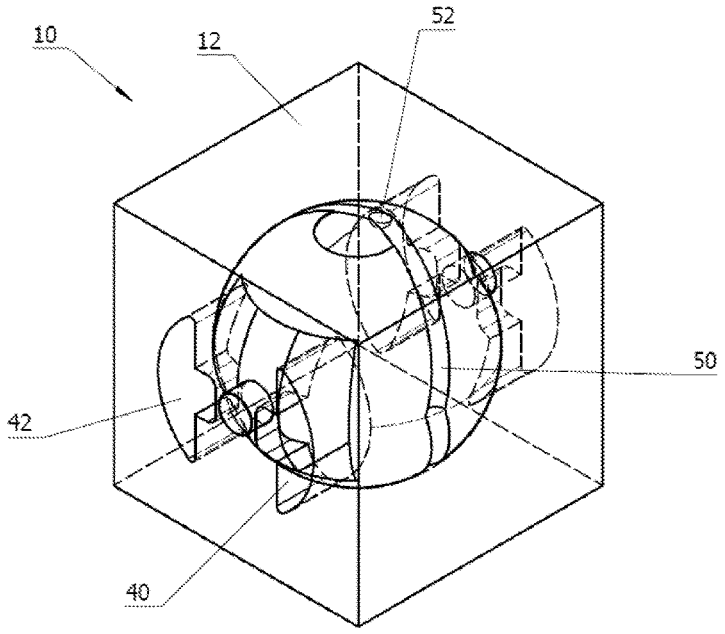
FIG. 5 shows a perspective semi "transparent" view of the apparatus according to the present disclosure.
Figure 6:
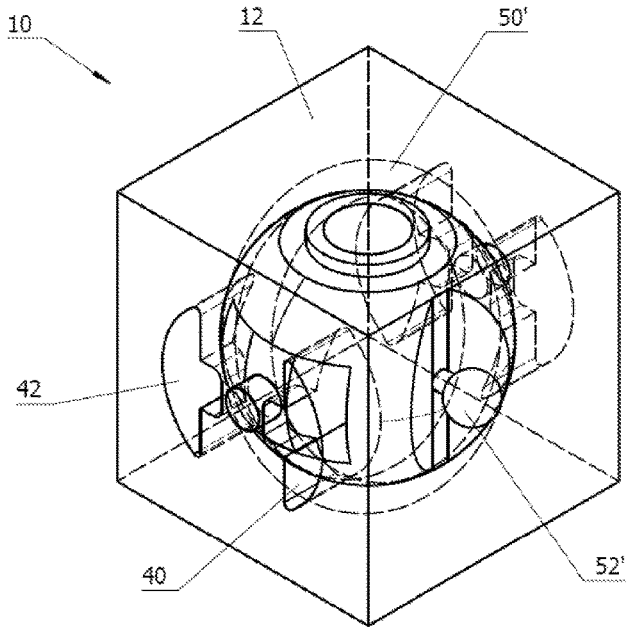
FIG. 6 shows an alternative example of an apparatus to that shown in FIG. 5.

A non-limiting example of the pivot actuator is illustrated in the examples shown in FIGS. 5, 6. In these figures, the apparatus 10 shown in FIG. 5 corresponds to that shown in FIGS. 1, 2.

A guide groove 50 is provided in the rotor and a stylus 52 (as can be seen in FIG. 1) is provided in the wall 24 of the housing 12 which sits within the groove 50. However in an alternative example shown in FIG. 6, a stylus 52' is provided on the rotor 16 and a guide groove 50' is provided in the housing 12. That is to say, the guide path 50, 50' may be provided on the rotor or the housing, and the other guide feature, the stylus 52, 52' may also either be provided on the rotor 16 or the housing 12.

Figure 7:
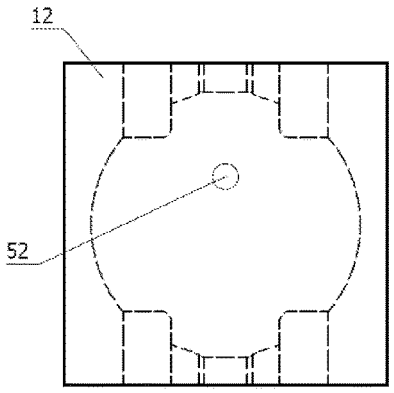
FIG. 7 shows a plan view of the housing shown in FIG. 5, with hidden detail shown in dotted lines.
Figure 8:
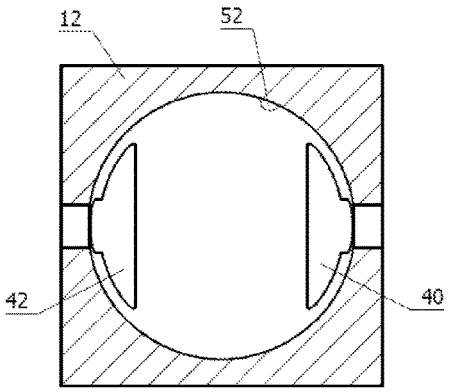
FIG. 8 shows a side sectional view of the housing shown in FIG. 5.

These examples are further illustrated with reference to cross section shown in FIGS. 7 and 8 which correspond to the example of FIG. 5, and FIGS. 9, 10 which correspond to the example of FIG. 6.

Figure 11:
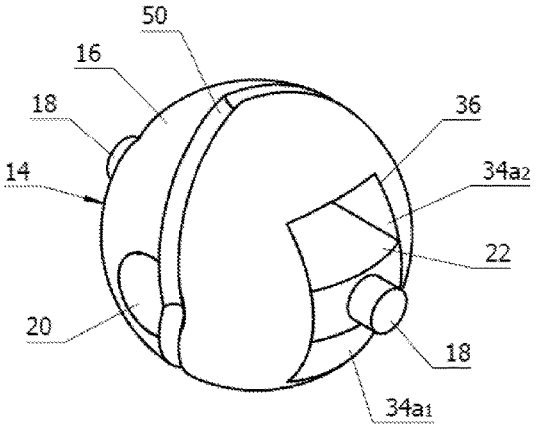
FIG. 11 shows an alternative view of the rotor assembly shown in FIG. 3.
Figure 12:
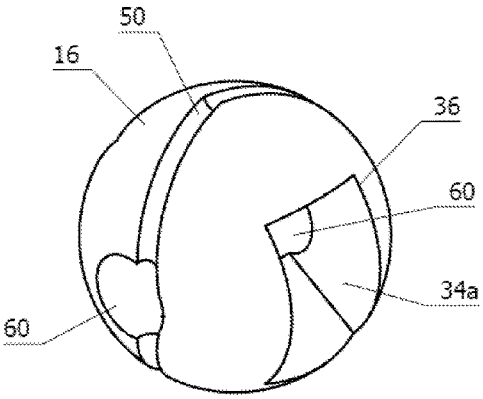
FIG. 12 shows the rotor of the rotor assembly of FIG. 11.
Figure 13:
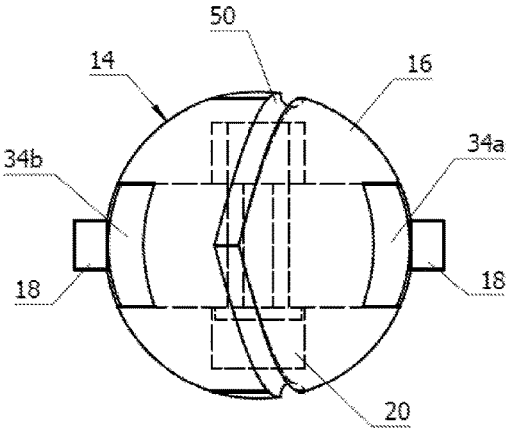
FIG. 13 shows a plan view of the rotor assembly shown in FIG. 11.
Figure 14:
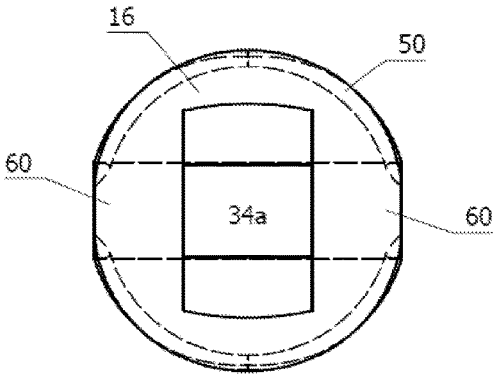
FIG. 14 shows an end on view of the rotor shown in FIG. 12.

FIGS. 11, 12 show the rotor assembly 14 and a rotor 16 according to the examples shown in FIGS. 1, 3. The rotor 16 is substantially spherical. For convenience FIG. 11 shows the entire rotor assembly 14 with shaft 18, axle 20 and piston member 22 fitted. By contrast, FIG. 12 shows the rotor 16 by itself, and a cavity 60 which extends through the rotor 16 and is configured to receive the axle 20. FIG. 13 shows a plan view of the arrangement shown in FIG. 11, and FIG. 14 shows an end on view looking down the opening 36 which defines the chamber 34 of the rotor 16.

The rotor 16 may be provided in one or more parts which are assembled together around the shaft 18 and axle 20 assembly. Alternatively the rotor 16 may be provided as one piece, whether integrally formed as one piece or fabricated from several parts to form one element, in which case the axle 20 may be slid into the cavity 60, and then the shaft 18 and piston member 22 slid into a passage 62 formed in the axle 20, and then fixed together.

Figure 15:
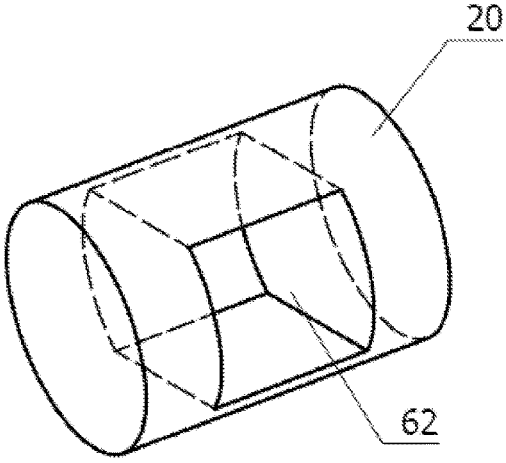
FIG. 15 shows a perspective view of an axle of the rotor assembly.
Figure 16:
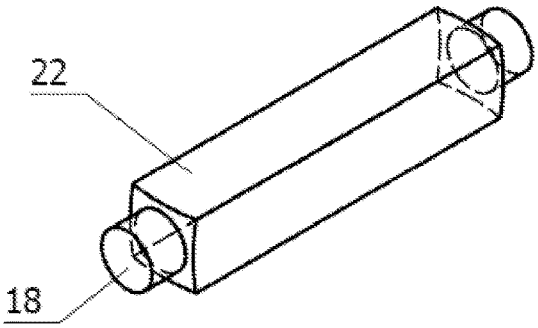
FIG. 16 shows an perspective view of a shaft of the rotor assembly.

FIG. 15 shows a perspective view of the axle 20 having the passage 62 for receiving the axle 18 and piston member 22. The axle 20 is substantially cylindrical. FIG. 16 shows an example configuration of the shaft 18 and piston member 22. The shaft 18 and piston member 22 may be integrally formed, as shown in FIG. 16, or may be fabricated from a number of parts. The piston member 22 is substantially square or rectangular in cross section. As shown in the figures, the shaft 18 may comprise cylindrical bearing regions which extend from the piston member 22 in order to seat on the bearing arrangement 44 of the housing 12, and hence permit rotation of the shaft 18 around the first rotational axis 30.

Figure 17:
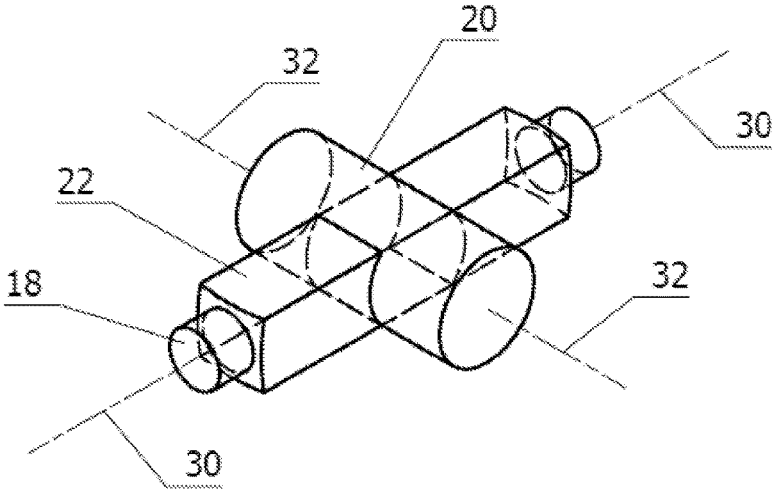
FIG. 17 shows an assembly of the axle of FIG. 15 and the shaft of FIG. 16.

FIG. 17 shows the shaft 18 and piston member 22 assembled with the axle 20. They may be formed as an assembly, as described above, or they may be integrally formed as one, perhaps by casting or forging.

The axle 20 may be provided substantially at the centre of the shaft 18 and piston member 22. That is to say, the axle 20 may be provided substantially halfway between the two ends of the shaft 18. When assembled, the shaft 18, axle 20 and piston member 22 may be fixed relative to one another. The axle 20 may be substantially perpendicular to the shaft and piston member 22, and hence the second rotational axis 32 may be substantially perpendicular to the first rotational axis 30.

The piston members 22 are sized to terminate proximate to the wall 24 of the housing 12, a small clearance being maintained between the end of the piston members 22 and the housing wall 24. The clearance may be small enough to provide a seal between the piston members 22 and the housing wall 24. Alternatively or additionally, sealing members may be provided in the clearance between the housing wall 24 the piston members 22.

Figure 18:
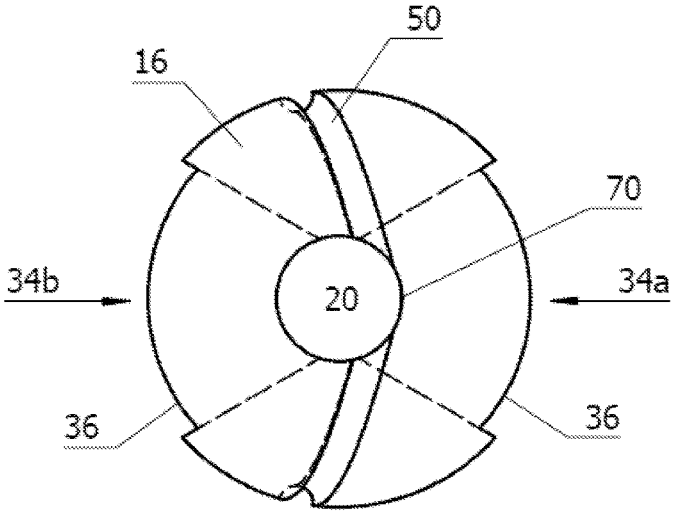
FIG. 18 shows a side view of the rotor of FIG. 12.
Figure 19:
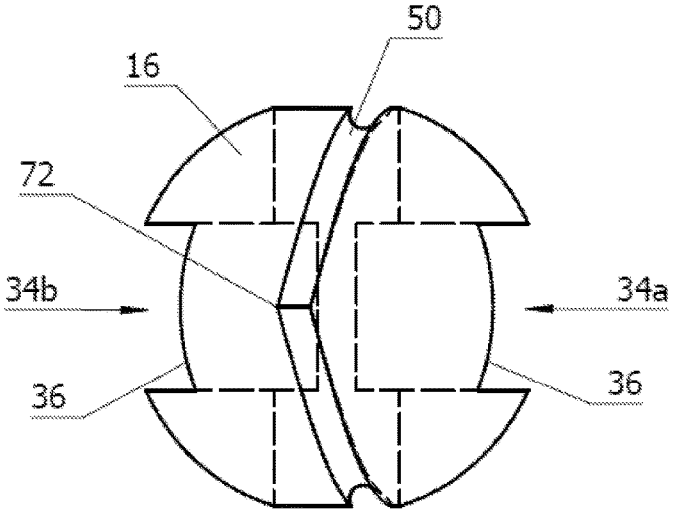
FIG. 19 shows a plan view of the rotor of FIG. 12.
Figure 20:
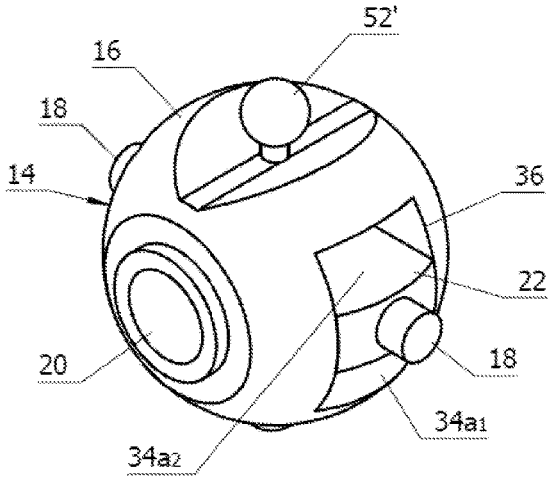
FIG. 20 shows an alternative example of a rotor assembly.

As shown clearly in FIGS. 18, 19, in an example where the guide feature is provided as a path on the rotor 16, the guide path 50 describes a path around (i.e. on, close to, and/or to either side of) a first circumference of the rotor or housing. In this example the plane of the first circumference overlays, or is aligned with, the plane described by the second rotational axis 32 as it rotates about the first rotational axis 30. The same is true for examples akin to that shown in FIG. 6 where the path 50' is provided in the housing 12.

The guide path 50, 50' comprises at least a first inflexion point 70 to direct the path away from a first side of the first circumference then toward a second side of the first circumference, and a second inflexion point 72 to direct the path 50, 50' away from the second side of the first circumference and then back toward the first side of the first circumference. The path 50 does not follow the path of the first circumference, but rather oscillates from side to side of the first circumference. That is to say, the path 50 does not follow the path of the first circumference, but defines a sinusoidal route between either side of the first circumference. The path 50 may be offset from the second rotational axis 32. Hence as the rotor 16 is turned about the first rotational axis 30, the interaction of the path 50,50' and stylus 52, 52' tilts (i.e. rocks or pivots) the rotor 16 backwards and forwards around the axle 20 and hence the second rotational axis 32.

In such an example, the distance which the guide path extends from an inflexion 70,72 on one side of the first circumference to an inflexion 70,72 on the other side of the circumference defines the relationship between the pivot angle of the rotor 16 about the second rotational axis 32 and the angular rotation of the shaft 18 about the first rotational axis 30. The number of inflexions 70,72 defines a ratio of number of pivots (e.g. compression, expansion, displacement cycles etc) of the rotor 16 about the second rotational axis 32 per revolution of the rotor 16 about the first rotational axis 30.

That is to say, the trend of the guide path 50,50' defines a ramp, amplitude and frequency of the rotor 16 about the second rotational axis 32 in relation to the rotation of the first rotational axis 30, thereby defining a ratio of angular displacement of the chambers 34 in relation to the radial reward from the shaft (or vice versa) at any point.

Put another way the attitude of the path 50,50' directly describes the mechanical ratio/relationship between the rotational velocity of the rotor and the rate of change of volume of the rotor chambers 34*a*, 34*b*. That is to say, the trajectory of the path 50,50' directly describes the mechanical ratio/relationship between the rotational velocity of the rotor 16 and the rate of pivot of the rotor 16. Hence the rate of change in chamber volume in relation to the rotational velocity of the rotor assembly 14 is set by the severity of the trajectory change (i.e. the inflexion) of the guide path.

The profile of the groove can be tuned to produce a variety of displacement versus compression characteristics, as combustion engines for petrol, diesel (and other fuels), pump and expansion may require different characteristics and/or tuning during the operational life of the rotor assembly. Put another way, the trajectory of the path 50,50' can be varied.

Thus the guide path 50, 50' provides a "programmable crank path" which may be pre-set for any given application of the apparatus.

Alternatively the features defining the guide path 50, 50' may be moveable to allow adjustment of the path 50, 50', which may provide dynamic adjustment of the crank path while the apparatus is in operation. This may allow for tuning of rate and extent of the pivoting action of the rotor about the second rotational axis to assist with controlling performance and/or efficiency of the apparatus. That is to say, an adjustable crank path would enable variation of the mechanical ratio/relationship between the rotational velocity of the rotor and the rate of change of volume of the rotor chambers 34*a*, 34*b*. Hence the path 50, 50' may be provided as a channel element, or the like, which is fitted to the rotor 12 and rotor housing 16, and which can be moved and/or adjusted, in part or as a whole, relative to the rotor 12 and rotor housing 16.

A rotor assembly 14 akin to the example shown in FIG. 6 is shown in FIGS. 20 to 23. As can be seen, this is similar to the examples shown in FIGS. 11 to 14, except that instead of a guide groove 50 on the rotor 16, there is provided a stylus 52' on the rotor 16 for engagement with a guide groove 50' on the housing 12.

Figure 24:
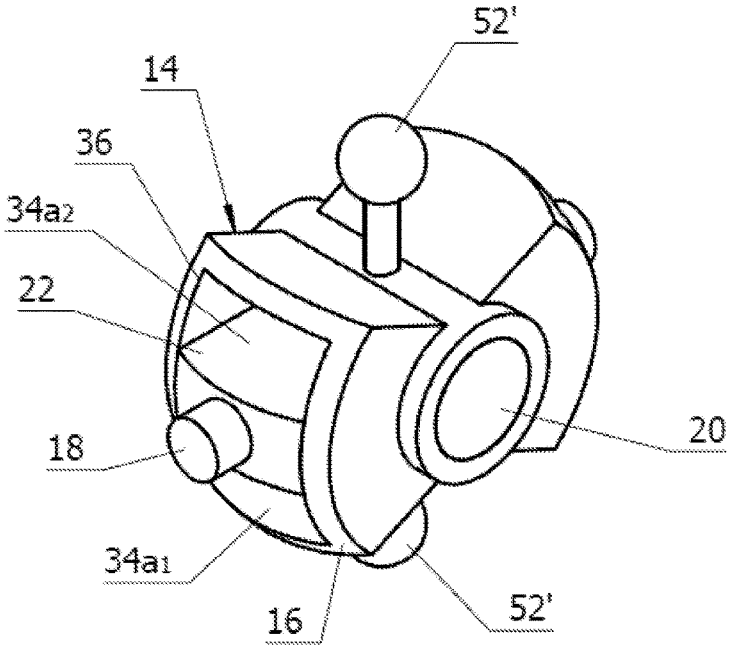
FIG. 24 shows a further alternative example of a rotor assembly.
Figure 25:
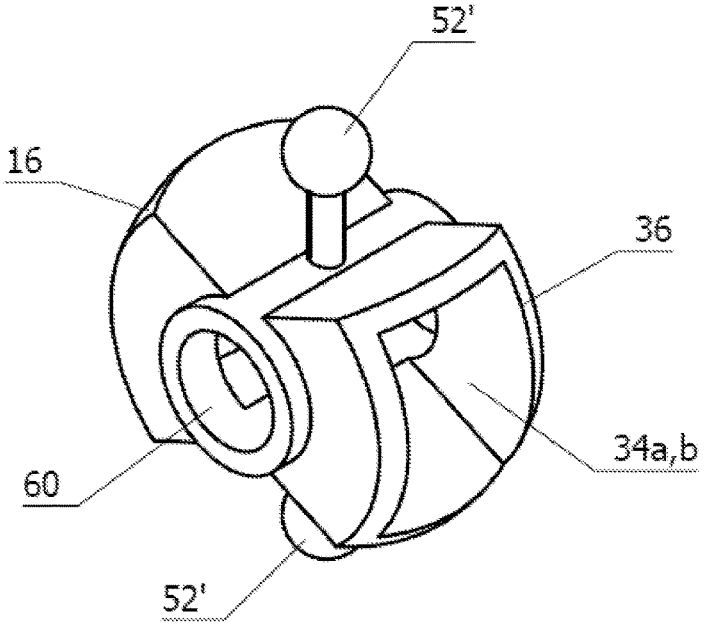
FIG. 25 shows perspective view of the rotor of the rotor assembly of FIG. 24.

A further example of a rotor housing 14 and rotor 16 are shown in FIGS. 24, 25. This is essentially the same as the examples of FIGS. 20 to 23, except that instead of a substantially spherical rotor body, the rotor 16 comprises substantially less material, only walls being provided to define the chambers 34 and cavity 60 for receiving the axle 20. In all other respects it is the same as the examples of FIGS. 20 to 23.

Figure 9:
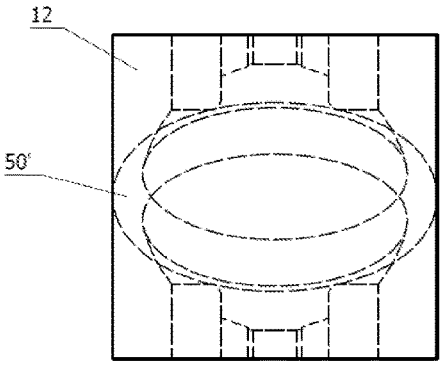
FIG. 9 shows a plan view of the housing shown in FIG. 6, with hidden detail shown in dotted lines.
Figure 10:
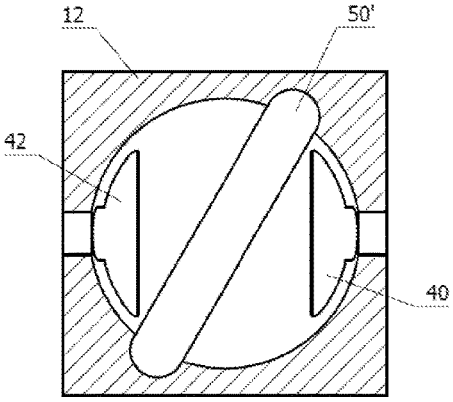
FIG. 10 shows a plan view of the housing shown in FIG. 6.
Figure 30:
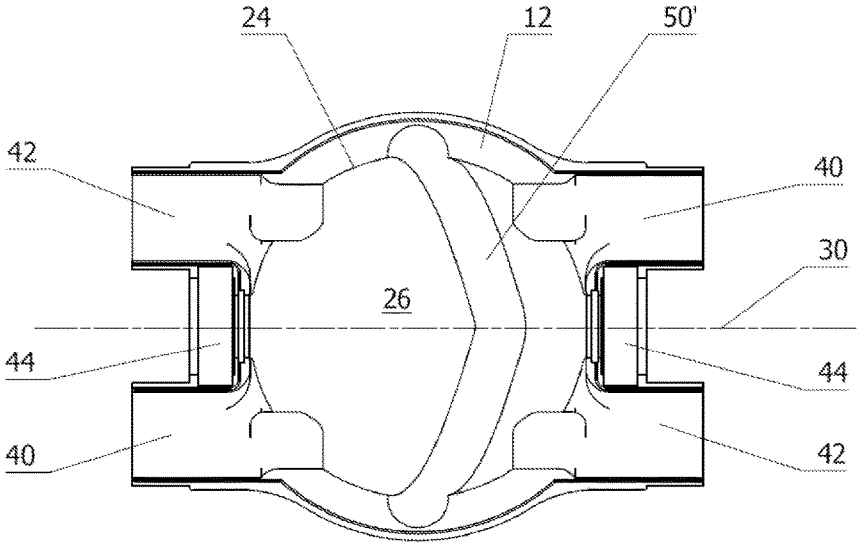
FIG. 30 shows an internal view of an alternative example of a rotor housing.

FIG. 30 shows an alternative housing to that shown in FIGS. 6, 9, 10. FIG. 30 shows a half housing split along the horizontal plane upon which the first rotational axis 30 sits. In this example the inlet and outlet ports 40,42 transform from a CT' shape on the inside of the housing to a substantially round shape on the external surface of the housing 12. The guide path 50' defines a different route to that shown in FIGS. 6, 9, 10, defining a path with an inflexion. As described previously, in operation, the path and inflexion define the rate of change of displacement of the rotor 16 relative to the piston 22, enabling a profound effect on the mechanical reward between the rotation and pivoting of the rotor 16. The route may be optimised to meet the needs of the application. That is to say, the guide path may be programmed to suit differing applications.

Figure 21:
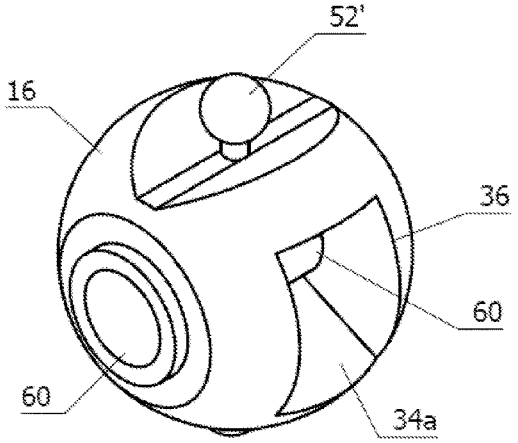
FIG. 21 shows the rotor of the rotor assembly of FIG. 20.
Figure 22:
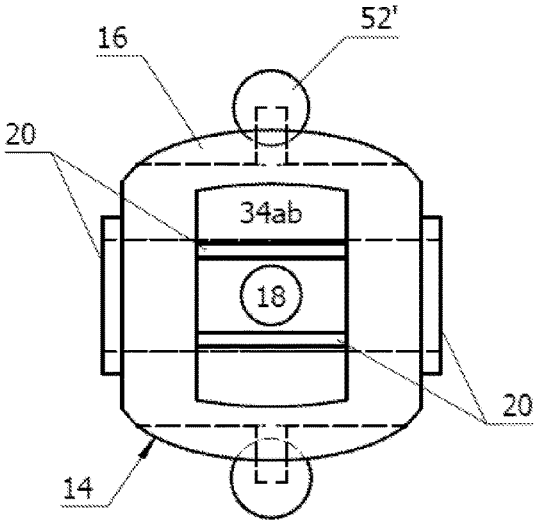
FIG. 22 shows an end on view of the rotor assembly of FIG. 20.
Figure 23:
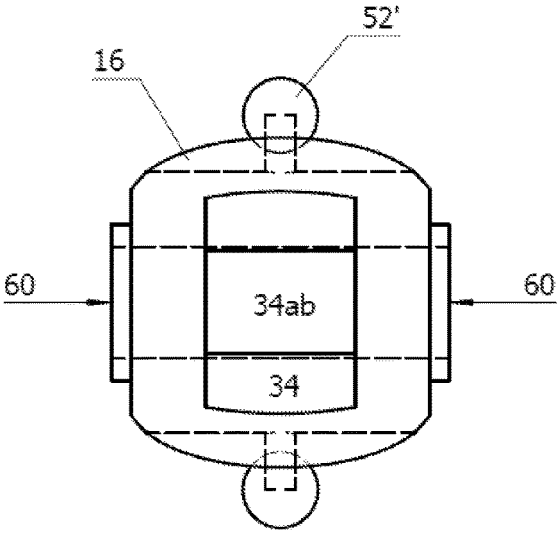
FIG. 23 shows an end on view of the rotor of FIG. 21.
Figure 31:
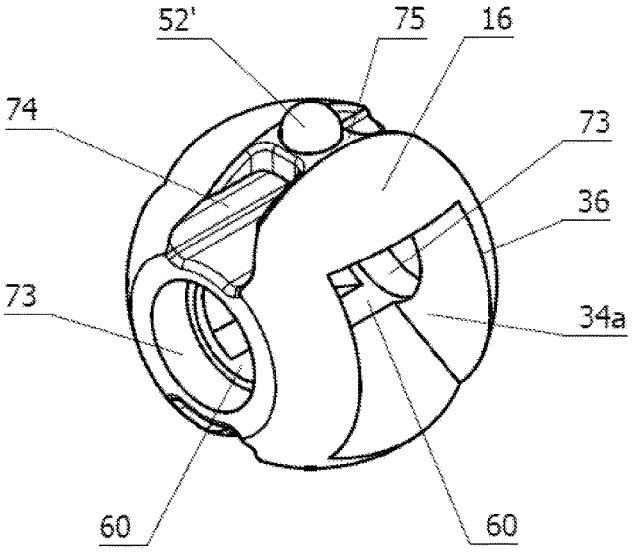
FIG. 31 shows an alternative example of rotor.

FIG. 31 shows another non limiting example of a rotor 16, akin to that shown in FIGS. 21, 25. Bearing lands 73 are shown for receiving a bearing assembly (e.g. a roller bearing arrangement), or providing a bearing surface, to carry the rotor 16 on the axle 20. Also shown is a "cut out" feature 74 provided as a cavity in a non-critical region of the rotor, which lightens the structure (i.e. provides a weight saving feature) and provides a land to grip/clamp/support the rotor 16 during manufacture. An additional land 75 adjacent the stylus 52' may also be provided to grip/clamp/support the rotor 16 during manufacture.

In examples where the apparatus is employed as a fluid pump (e.g. for fluid compression and/or displacement), the shaft 18 may be coupled to a drive motor to turn the rotor within the housing 12.

In examples where the apparatus forms part of an internal combustion engine, the shaft 18 may be coupled to a power off take, gear box or other device to be powered by the self perpetuating rotating rotor assembly. In such an example, the chambers 34 may be in fluid communication with a fuel supply (for example, air), and in fluid communication with a fuel ignition device (for example a spark ignition device). The apparatus may also be configured such that, at a pre-determined point in a compression cycle, the fuel may be introduced, compressed, ignited and burnt to expand the fluid in the chambers, to thereby induce movement of the piston member 22 and hence perpetuate the rotation of the rotor assembly 14. Ignition may be initiated from various places, for example from the housing 12, in the opening 36, or central to the chamber 34 via an insulated electrode mounted within the rotor body and making contact with a suitably timed stationary power source.

Figure 26:
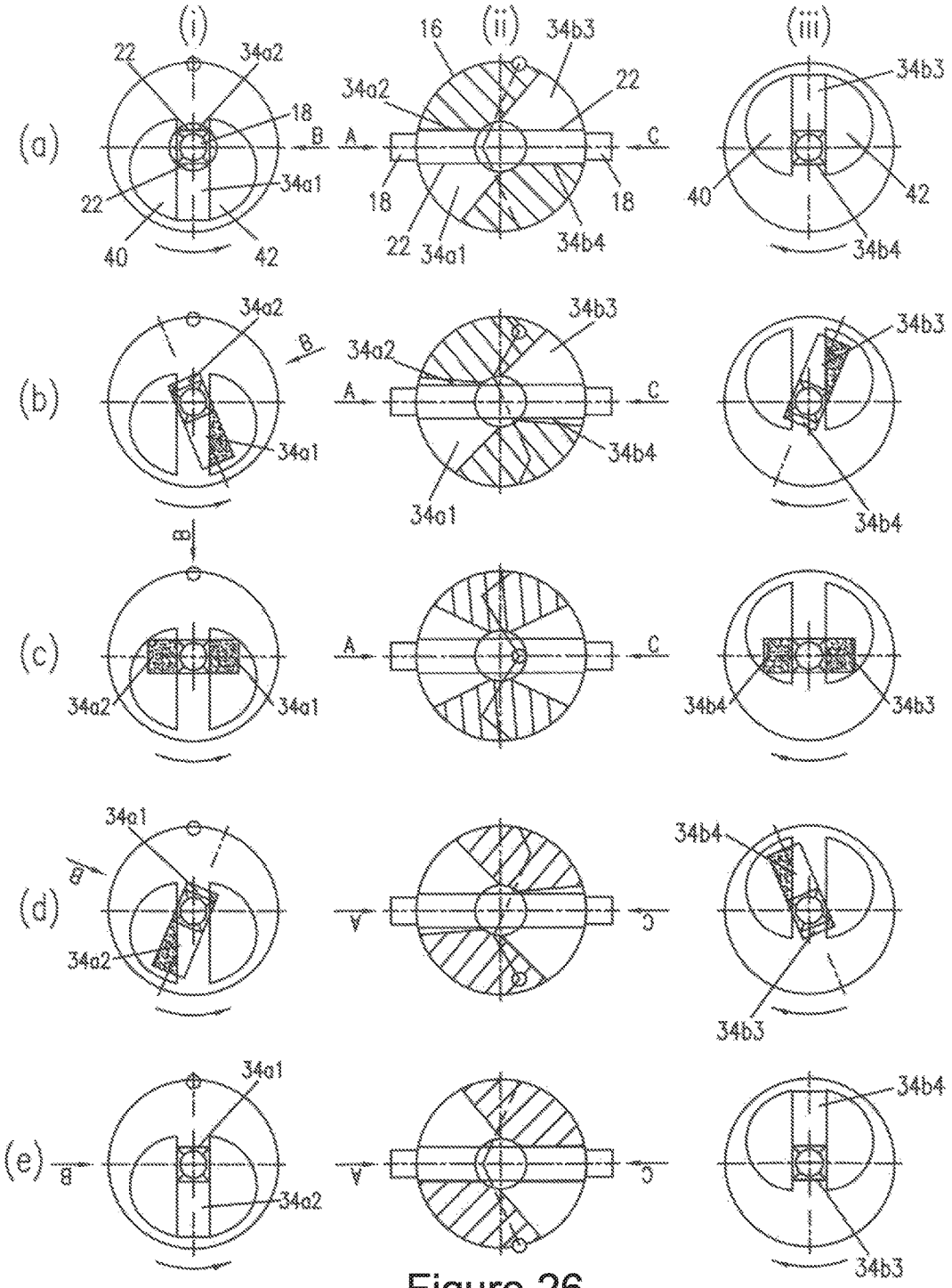
FIG. 26 illustrates a cycle of a pump comprising an apparatus of the present disclosure.

FIG. 26 illustrates how the examples of FIGS. 1 to 25 may operate when configured as a fluid pump (e.g. a fluid compression apparatus and/or fluid displacement apparatus). The central figure (ii) on each line illustrates a cross sectional view of the rotor 16 with a shaft 18 and piston member 22 installed. The figure to the left (i) shows an end on view of the central figure (ii). The figure (iii) to the right shows an end on view of the opposite side of the rotor assembly. The rotor assembly is symmetrical.

FIG. 26(*a*) shows the state of each sub-chamber 34*a*1, 34*a*2, 34*b*3, 34*b*4 at a nominal 0 degree angular position in an operational cycle. Sub-chambers 34*a*1, 34*b*3 are at full volume, full of fluid and about to begin a discharge cycle through exhaust port 42. Sub-chambers 34*a*2, 34*b*4 are fully compressed/displaced, emptied and ready to begin a fill cycle through intake port 40.

FIG. 26(*b*) shows the state of each sub-chambers 34*a*1, 34*a*2, 34*b*3, 34*b*4 rotated to a 22.5 degree position in the operational cycle. Sub-chambers 34*a*1, 34*b*3 begin compression/displacement and start to discharge through the exhaust port 42. Conversely sub-chambers 34*a*2, 34*b*4 begin increasing in volume (i.e. expand) and draw in fluid in through the inlet port 40.

FIG. 26(*c*) shows the state of each sub-chambers 34*a*1, 34*a*2, 34*b*3, 34*b*4 rotated to a 90 degree position in the operational cycle. Sub-chambers 34*a*1, 34*b*3 are midway through compression/displacement and discharging through the exhaust port. Conversely sub-chambers 34*a*2, 34*b*4 are mid-way through expansion and continue draw in fluid through the inlet port.

FIG. 26(*d*) shows the state of each sub-chamber 34*a*1, 34*a*2, 34*b*3, 34*b*4 rotated to a 157.5 degree position in the operational cycle. Sub-chambers 34*a*1, 34*b*3 are approaching full compression/displacement and are almost empty. Conversely sub-chambers 34*a*2, 34*b*4 are approaching full expansion and are nearly completely full of fluid.

FIG. 26(*e*) shows the state of each sub-chamber 34*a*1, 34*a*2, 34*b*3, 34*b*4 rotated to a 180 degree position in the operational cycle. Sub chambers 34*a*1, 34*b*3 are fully compressed/displaced and empty and ready to begin a fill cycle. Conversely sub-chambers 34*a*2, 34*b*4 are fully expanded and loaded and ready to begin a discharge cycle. Beyond this point, the cycle may start again, but note that at the 180 degree point sub-chambers 34*a*1, 34*a*2 have fully exchanged roles, as have sub-chambers 34*b*3 and 34*b*4. Between 180 degrees and 360 degrees the above process is repeated in line with these role reversals.

Figure 27:
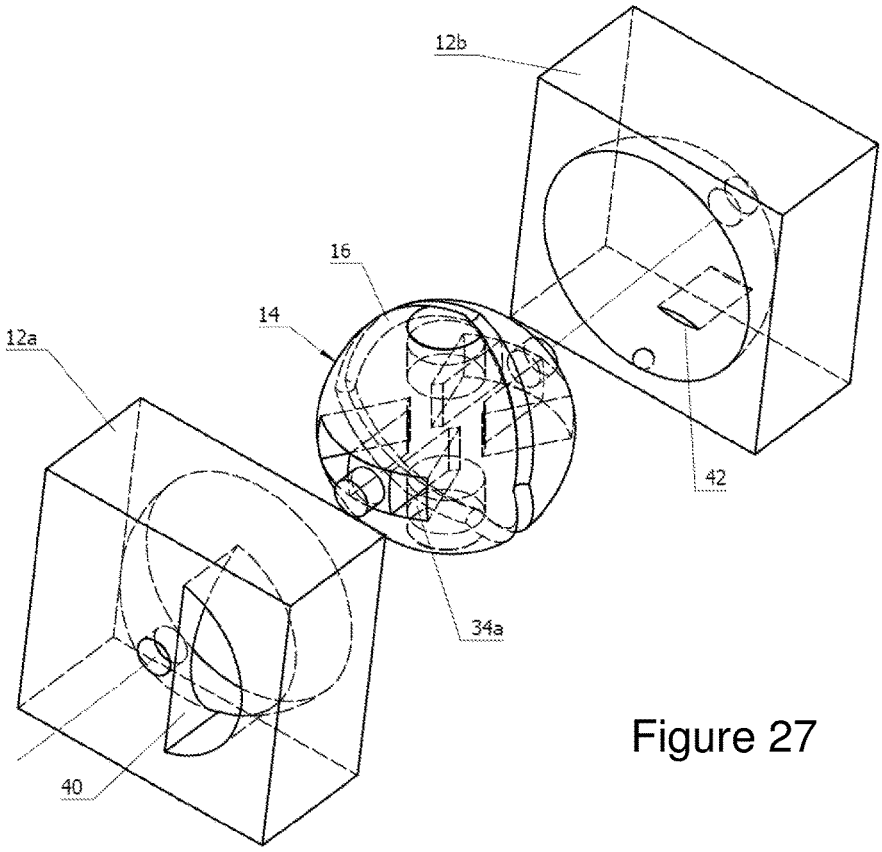
FIG. 27 shows a part exploded perspective view of an alternative example of an apparatus of the present disclosure.
Figure 28:
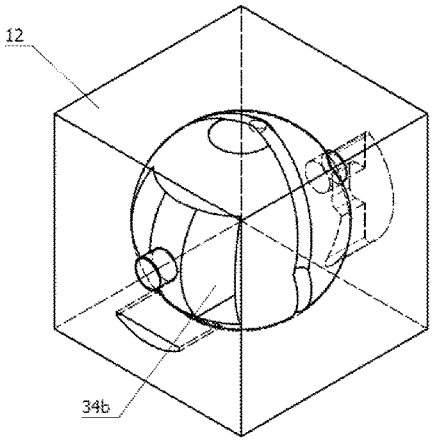
FIG. 28 shows a perspective semi "transparent" view of the housing surrounding the rotor assembly of FIG. 27, with the apparatus rotated through at 180 degrees.

FIGS. 27, 28 show an alternative example of the apparatus, provided as part of an internal combustion engine akin to a "two stroke" cycle engine. FIG. 27 shows a part exploded perspective view of the engine from one angle. FIG. 28 shows a semi "transparent" view of a variation of the engine from a different angle. The examples of FIG. 27, 28 are identical other than FIG. 28 also illustrates a piston member 22 and compression chamber 34 with a different aspect ratio to that of FIG. 27. In many respects the rotor assembly 14 of these examples is the same as described in previous examples.

However, an important difference is there is provided at least one closable flow passage 80 between the first compression chamber 34*a* on one side of the rotor assembly 14 and the second compression chamber 34*b* on the other side of the rotor assembly 14. The flow passage 80 may comprise a flow path in the axle 20 which is open when the rotor is pivoted to one extent of its pivot, and closed when the rotor is pivoted towards the other extent of its pivot motion. A further significant difference between the examples of FIGS. 27, 28 and that of the preceding examples, is that the housing comprises only one port per compression chamber 34*a*,34*b* for communication of fluid between a fluid passage and the respective compression chamber 34*a*, 34*b*. There is provided an inlet port 40 in one half of housing 12*a* and an exhaust port 42 provided in the other half of the housing 12*b*. In this example, the exhaust port 42 is significantly smaller in cross sectional area than inlet port 40.

Figure 29:
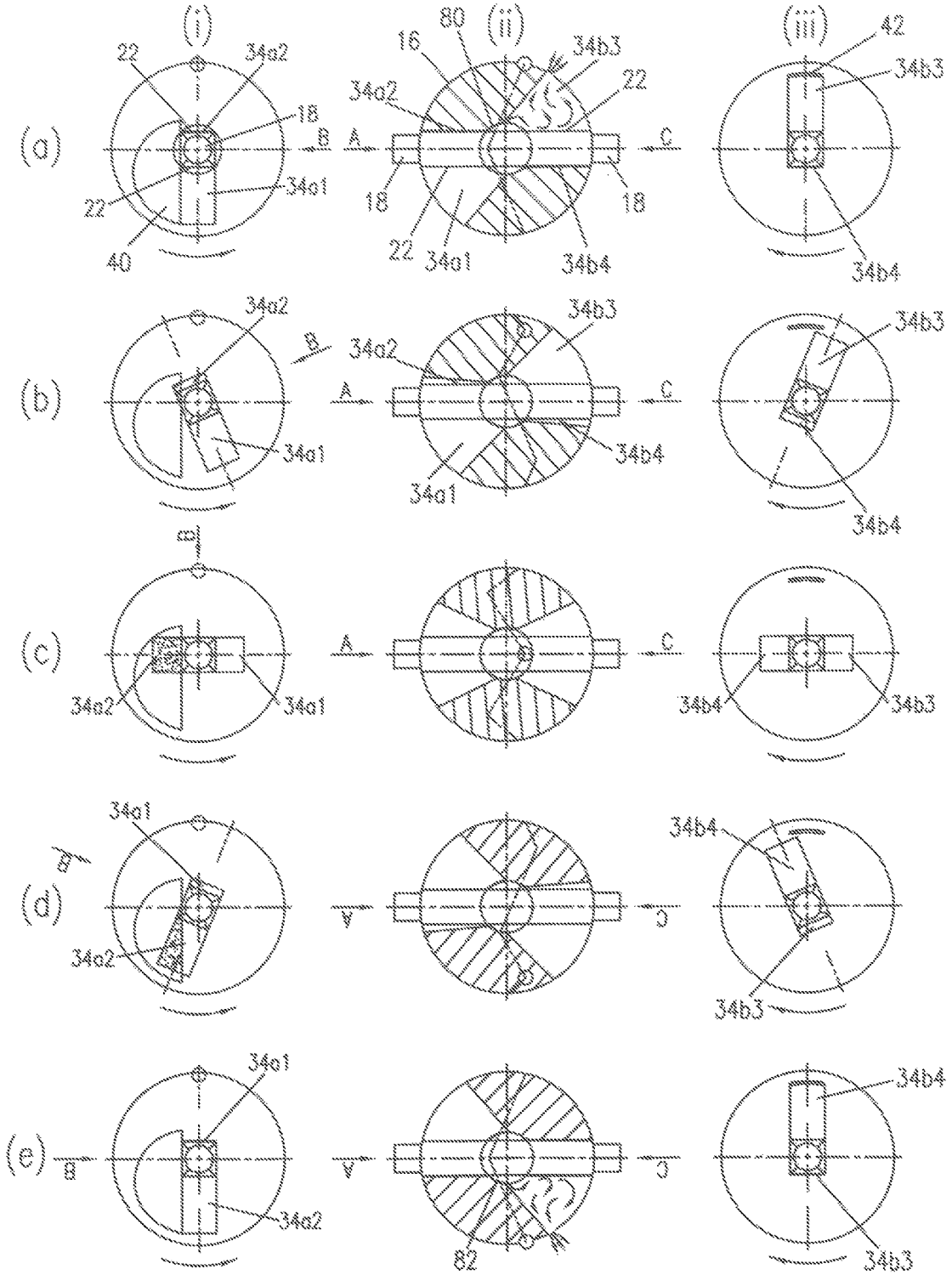
FIG. 29 shows an example of an operation cycle of the example of FIGS. 27, 28.

FIG. 29 illustrates how a combustion cycle of the examples of FIGS. 27, 28 may operate. The central figure (ii) on each line illustrates a cross sectional view of the rotor 16 with a shaft 18 and piston member installed. The figure to the left (i) shows an end on view of the central figure (ii). The figure (iii) to the right shows an end on view of the opposite side of the rotor assembly.

In FIG. 29(*a*), at zero degree rotation, sub-chamber 34*a*1 is fully loaded after an induction phase having drawn air through the inlet port 40. Sub-chamber 34*a*2 is fully compressed, and discharges into sub-chamber 34*b*3 through the closable flow passage 80 between sub-chambers 34*a*1 and 34*b*3. Sub-chamber 34*b*3 is fully open, and aligned in part with the exhaust port 42. Sub-chamber 34*b*4 contains a fully compressed air-fuel mix, and begins its power (i.e. ignition) stroke.

Fuel is introduced into sub-chamber 34*b*3 during one of the stages set out in FIG. 29(*b*), (*c*) or (*d*) below.

FIG. 29(*b*) illustrates a 22.5 degrees angular position. Sub-chamber 34*a*1, now closed, begins a compression stroke. Sub-chamber 34*a*2 begins expanding, and draws fluid in through the inlet port 40. Sub-chamber 34*b*3, now closed, begins compression. In sub-chamber 34*b*4, the fuel-air mix is ignited and combusts, causing expansion which induces relative motion between the piston member 22 and the rotor 16, thereby inducing rotation of the rotor 16 about the first rotational axis 30.

FIG. 29(*c*) illustrates a 90 degrees rotation. Sub-chamber 34*a*1, still closed, is midway through compression. Sub-chamber 34*a*2 is midway through expansion, and is still drawing in fluid through the inlet port 40. Sub-chamber 34*b*3, still closed, is in mid compression stroke. Sub-chamber 34*b*4 is mid-way through the power stroke, and is still being driven open by the combustion therein.

FIG. 29(*d*) illustrates a 157.5 degrees angular position. Sub-chamber 34*a*1, still closed, is approaching full compression. Sub-chamber 34*a*2 is approaching full expansion, and is still drawing in through the inlet port 40. Sub-chamber 34*b*3, still closed, is nearing the end of its compression stroke. Sub-chamber 34*b*4, still being expanded by the combustion process, is nearing the end of its power stroke.

FIG. 29(*e*) illustrates a 180 degrees angular position. Sub-chamber 34*a*1 is fully compressed, and discharges into sub chamber 34*b*4 through the closable flow passage 80 there between. Sub-chamber 34*a*2 is fully loaded after an induction phase. Sub-chamber 34*b*3 is fully compressed, and is ready to begin its ignition (power) stroke to power the next 180 degrees rotation. Sub-chamber 34*b*4 is fully open and aligned with the exhaust port 42 for an instant, and simultaneously aligns with the path from sub-chamber 34*a*1.

At the 180 degrees point, chambers 34*a*1 and 34*b*2 have fully exchanged roles, as have chambers 34*b*3 and 34*b*4. Between 180 degrees and 360 degrees the above process is repeated in line with the role reversals.

The angular positions used in the examples above in respect of FIGS. 26, 29 are by way of non-limiting example only.

In examples where the apparatus is part of a fluid expansion apparatus, the pivoting motion is caused by the expansion of fluid within at least one of the chamber(s) 34 to thereby move a side wall of the first chamber 34*a* away from the first piston member 22, and thereby cause the rotor stylus 52, 52' to act against the guide path 50, 50' and thus induce rotation of the rotor 16 about the first rotational axis. For example, the apparatus of the present disclosure may be provided as part of a generation system "downstream" of a source of steam (e.g. exhaust from a steam turbine), and receive steam through the inlet ports 40. As the steam expands, the rotor 16 and shaft 18 rotate around the first rotational axis 30, the rotation of the shaft 18 being used for driving a generator or other device. The expanded fluid is may be driven from the expansion chamber 34*a* by the expansion of fluid in the other of the expansion chambers 34*b*.

In an alternative example, the apparatus may form part of an expansion reactor for a chemical reaction which harnesses thermodynamic expansion to drive the rotation of the rotor about the first rotational axis 30 for power take off. In such an example, the chambers 34 receiving the chemical may not have an opening 36, although may be provided with an injection device to deliver the chemical to the chamber(s) 34. Hence the chambers 34 may be defined as closed voids/cavities within the rotor 16. In such an example, the fuel employed may be hydrogen peroxide or the like.

In examples where the apparatus is a fluid actuated apparatus, the pivoting motion is caused by the flow of fluid into the chamber 34*a* to thereby move a side wall of the first chamber 34*a* away from the first piston member 22, and thereby cause the rotor stylus to act against the guide path and thus induce rotation of the rotor 16 about the first rotational axis 30 for power take off. For example, the apparatus of the present disclosure may be provided as a hydraulic or pneumatic motor. In such an example, the apparatus may be configured to receive fluid through the inlet ports 40. As the fluid flows, the rotor 16 and shaft 18 rotate around the first rotational axis. The fluid can exit under gravity or is driven from its chamber by flow of fluid into the successive chamber.

In further alternative examples, the apparatus may form part of a flow regulating or metering device. In such an example, the apparatus may be configured to receive fluid through the inlet ports 40. As the fluid flows, the rotor 16 and shaft 18 rotate around the first rotational axis. The fluid is driven from its chamber 34*a* by flow of fluid into the subsequent chamber. The shaft speed may be measured, controlled and/or limited to measure or restrict flow rate through the device.

In a further example, two such roticulating units completely remote from each other may be coupled for rigid fluid transfer between each other, operable for use as a hydraulic gear system or hydraulic differential (by hydraulically coupling three units). In such an example the fluid acts as an energy transfer medium to distribute an input torque to an output torque on the other remote unit(s), and a difference in the coupled units volume would impart a change in rotor speed. This system would offer an intrinsically safe method of getting rotational power into high risk or explosive atmospheres.

Although a number of examples of how the apparatus may be utilised have been described, the present disclosure is not limited to these examples as the core elements of the rotor assembly and this ingenious 'roticulating' arrangement may be utilised in further applications.

The simple roticulating joint provided by the apparatus of the present disclosure allows the rotor to simultaneously rotate and articulate (i.e. pivot) and thereby be utilised to perform work and desired functions.

For example it may be applied in many applications in which it is required to convert volumetric energy to rotational work, or to convert rotational input to displacement of fluid, or control of fluid flow. Put another way, the device is suitable for translating volumetric displacement into a rotational force, and/or translating a rotational force into volumetric displacement.

The apparatus is thus a bi directional bi modal torque/pressure conversion device. It may be configured to convert a positive or negative pressure into a rotational force. Alternatively it may be configured to convert a rotational force into a compressive or evacuative force. Hence it may be configured to linearly displace media, or compressively displace media.

As described above it may form part of a heat engine, a steam engine, a fluid (e.g. water) meter, a fluid turbine, a hydraulic or pneumatic motor. It may also be utilised to extract rotational energy from a vacuum source.

The apparatus may form part of a device for vacuum generation (i.e. a vacuum pump). The apparatus may alternatively form part of a device to manage the expansion of gases from their liquid state to a gaseous one or expansion of refrigerant gasses. In such an example, the apparatus may be coupled to a driven or controlled rotation means, for example a brake or motor which restricts the rotation of the rotor to a desired speed, thereby providing controlled expansion of gas/fluid in the chambers, which may either not rotate the rotor by themselves to allow controlled expansion or may cause the rotor to rotate too fast and thus not achieve the full advantage of a controlled expansion.

Given it is a true positive displacement unit which offers up to a 100% internal volume reduction per revolution, it can simultaneously perform 'push' and 'pull' operations, so for example can create a full vacuum on its inlet whilst simultaneously producing compressed air on its outlet, or combined and simultaneous suction pump and a discharge pump There is thus provided a compact apparatus, which may be adapted for use as a fluid pump, fluid displacement apparatus, internal combustion engine, fluid expansion device or fluid actuated device.

The rotor 16 and housing 12 may be configured with a small clearance between them thus enabling oil-less and vacuum operation, and/or obviate the need for contact sealing means between rotor 16 and housing 12, thereby minimising frictional losses.

The nature of the rotor assembly 14 is such that it may operate as a flywheel, obviating the need for a separate flywheel element common to other engine and pump designs, thereby contributing to a relatively light construction.

Additionally the apparatus of the present disclosure comprises only three major internal moving parts (the shaft, rotor and axle), thereby creating a device which is simple to manufacture and assemble.

Where applications which would benefit from such, the shaft 18 may extend out of both sides of the housing to be coupled to a powertrain for driving device and/or an electrical generator, or to couple a number of units inline.

The apparatus of the present invention can be scaled to any size to suit different capacities or power requirements, its dual output drive shaft also makes it easy to mount multiple drives on a common line shaft, thereby increasing capacity, smoothness, power output, offering redundancy, or more power on demand with little weight penalty for carrying a second internal combustion engine.

The device inherently has an extremely low inertia which offers low load and quick and easy start-up.

It is envisaged that a 250 mm diameter rotor can achieve 4.0 litres displacement per revolution (whilst facilitating a 100% reduction in volume). The volume of the drive trends with the volume of a sphere so a 400 mm dia offers approximately 10× the displacement of a 250 mm diameter rotor, with a potential maximum displacement of 40 litres per revolution.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A rotary fluid apparatus comprising:

a shaft which defines and is rotatable about a first rotational axis;

an axle defining a second rotational axis, the shaft extending through the axle;

a first piston member provided on the shaft, the first piston member extending from the axle towards a distal end of the shaft; and the shaft, the axle and the first piston member are fixed relative to one another;

a rotor carried on the axle;

the rotor comprising a first chamber with the first piston member extending across the first chamber;

whereby:

the rotor and axle are rotatable with the shaft around the first rotational axis; and the rotor is pivotable about the axle about the second rotational axis to permit relative pivoting motion between the rotor and the first piston member as the rotor rotates about the first rotational axis.

2. The rotary fluid apparatus as claimed in claim 1 wherein the first chamber has a first opening; and the first piston member extends from the axle across the first chamber towards the first opening.

3. The rotary fluid apparatus as claimed in claim 1 wherein the axle is provided half way between ends of the shaft.

4. The rotary fluid apparatus as claimed in claim 1 wherein the first piston member extends from one side of the axle along the shaft; and a second piston member extends from the other side of the axle along the shaft, the rotor comprising a second chamber to permit relative pivoting motion between the rotor and the second piston member as the rotor rotates about the first rotational axis.

5. The rotary fluid apparatus as claimed in claim 4 wherein the second chamber has a second opening; and the second piston member extends from the axle across the second chamber towards the second opening.

6. The rotary fluid apparatus as claimed in claim 4 wherein there is provided a closeable flow passage between the first chamber and the second chamber.

7. The rotary fluid apparatus as claimed in claim 6 wherein the closeable flow passage comprises a flow path in the axle which is open when the rotor is pivoted to one extent of its pivot, and closed as the rotor is pivoted towards its other extent of its pivot.

8. The rotary fluid apparatus as claimed in claim 4 wherein the second chamber is specifically adapted for one or more of compression of the fluid, displacement of the fluid, flow of the fluid, and expansion of the fluid.

9. The rotary fluid apparatus as claimed in claim 1 wherein the second rotational axis is perpendicular to the first rotational axis.

10. The rotary fluid apparatus as claimed in claim 1 further comprising:

a housing having a wall which defines a cavity;

the rotor being rotatable and pivotable within the cavity and disposed relative to the housing such that a small clearance is maintained between the rotor over the majority of the wall.

11. The rotary fluid apparatus as claimed in claim 10 wherein the housing further comprises a bearing arrangement for carrying the shaft.

12. The rotary fluid apparatus as claimed in claim 10 wherein: the first piston member is sized to terminate proximate to the wall of the housing with a small clearance being maintained between the end of the first piston member and the housing wall.

13. The rotary fluid apparatus as claimed in claim 10 wherein: the housing further comprises at least one port for each of the first chamber and a second chamber, which functions as an inlet port or an exhaust port for communication of fluid between a fluid passage and respective the first chamber and the second chamber.

14. The rotary fluid apparatus as claimed in claim 10 wherein:

for each of the first chamber and a second chamber, the housing further comprises an inlet port for delivering fluid into one of the first chamber or the second chamber; and an exhaust port for expelling fluid from one of the first chamber or the second chamber.

15. The rotary fluid apparatus as claimed in claim 14, wherein the ports are sized and positioned on the housing such that:

in a first set of relative positions of the inlet port and the exhaust port and the respective rotor openings, the inlet port and the exhaust port and rotor openings are out of alignment such that the openings are fully closed by the wall of the housing to prevent fluid flow between the one or more chambers and the inlet port and the exhaust port; and in a second set of relative positions of the inlet port and the exhaust port and the respective rotor openings, the openings are at least partly aligned with the inlet port and the exhaust port such that the openings are at least partly open to allow fluid to flow between the one or more chambers and the inlet port and the exhaust port.

16. The rotary fluid apparatus as claimed in claim 1 wherein the apparatus further comprises:

a pivot actuator operable to pivot the rotor about the axle.

17. The rotary fluid apparatus as claimed in claim 16 wherein the pivot actuator comprises:

a first guide feature on the rotor; and a second guide feature on the housing;

the first guide feature being complementary in shape to the second guide feature; and one of the first or second guide features defining a path which the other of the first or second guide members is constrained to follow;

thereby inducing the rotor to pivot about the axle.

18. The rotary fluid apparatus as claimed in claim 17 wherein:

the guide path describes a path around a first circumference of the rotor or housing, the guide path comprising at least:

a first inflexion which directs the guide path away from a first side of the first circumference of the rotor or housing and then back toward a second side of the first circumference of the rotor or housing; and a second inflexion which directs the guide path away from the second side of the first circumference of the rotor or housing and then back toward the first side of the first circumference of the rotor or housing.

19. The rotary fluid apparatus as claimed in claim 1 wherein the first chamber is specifically adapted for one or more of compression of the fluid, displacement of the fluid, flow of the fluid, and expansion of the fluid.

20. A method of operation of a rotary fluid apparatus that comprises a shaft which defines and is rotatable about a first rotational axis; an axle defining a second rotational axis with the shaft extending through the axle; a first piston member provided on the shaft; and the shaft, the axle and the first piston member are fixed relative to one another; the first piston member being rotatable about a first rotational axis; a rotor comprising a first chamber and pivotable about a second rotational axis, the first piston member extending across the first chamber;

the method comprising:

rotating the rotor and first piston member around the first rotational axis; and pivoting the rotor about the second rotational axis such that there is a relative pivoting motion between the rotor and the first piston member which varies the volume of the first chamber, with the change in chamber volume being linked to rotation of the rotor about the first rotational axis.

* * * * *